US011781717B2

(12) United States Patent
Kretschmann et al.

(10) Patent No.: US 11,781,717 B2
(45) Date of Patent: Oct. 10, 2023

(54) LIGHTING UNIT AND LUMINAIRE WITH SKEWED LED OPTICS PAIRS

(71) Applicant: Drägerwerk AG & Co. KGaA, Lübeck (DE)

(72) Inventors: Hanno Kretschmann, Lübeck (DE); Georg Spielberger, Lübeck (DE)

(73) Assignee: Drägerwerk AG & Co. KGaA, Lübeck (DE)

( * ) Notice: Subject to any disclaimer, the term of this patent is extended or adjusted under 35 U.S.C. 154(b) by 0 days.

(21) Appl. No.: 17/710,059

(22) Filed: Mar. 31, 2022

(65) Prior Publication Data

US 2022/0316664 A1 Oct. 6, 2022

(30) Foreign Application Priority Data

Apr. 1, 2021 (DE) ..... 10 2021 108 309.5

(51) Int. Cl.

| | |
|---|---|
| ***F21K 9/69*** | (2016.01) |
| ***F21V 33/00*** | (2006.01) |
| ***F21V 14/06*** | (2006.01) |
| ***F21V 5/00*** | (2018.01) |
| *F21W 131/205* | (2006.01) |

(Continued)

(52) U.S. Cl.

CPC ..... *F21K 9/69* (2016.08); *F21V 5/007* (2013.01); *F21V 14/06* (2013.01); *F21V 33/0068* (2013.01); *F21W 2131/20* (2013.01); *F21W 2131/205* (2013.01); *F21Y 2105/18* (2016.08);

(Continued)

(58) Field of Classification Search

CPC ..... F21Y 2107/50; F21V 5/007; F21V 14/06; F21V 33/0068; F21K 9/69; F21W 2131/20; F21W 2131/205

See application file for complete search history.

(56) References Cited

U.S. PATENT DOCUMENTS 6,250,774 B1 * 6/2001 Begemann ..... F21S 8/086 362/240
8,292,804 B2 * 10/2012 Marka ..... A61B 90/35 600/249

(Continued)

FOREIGN PATENT DOCUMENTS

CN 103162190 A 6/2013
DE 102011008474 B4 8/2012

(Continued)

*Primary Examiner* — Tracie Y Green
*Assistant Examiner* — Michael Chiang
(74) *Attorney, Agent, or Firm* — McGlew and Tuttle, P.C.

(57) ABSTRACT

A lighting unit (100) for a medical luminaire (150) has a number of groups of LEDs (110, 110', 110") that are connected to a common planar printed circuit board (115). Each LED (112, 112') of at least one of the groups (110, 110') is associated with a respective optic (122, 122') by which a respective LED-optic pair (120, 120') is formed. The respective optics, based on the structure (328), specify a tilt angle (125) of a central light beam axis (124, 124') of an emitted light beam of the LED optics pair in a tilt direction (627) of the respective LED optics pair. The tilt direction is defined such that the respective light beam axes of the emitted light beams of the LED optics pairs from the at least one group of LEDs are at least partially skewed in pairs with respect to one another.

19 Claims, 8 Drawing Sheets

(51) Int. Cl.

| | |
|---|---|
| *F21Y 105/18* | (2016.01) |
| *F21Y 115/10* | (2016.01) |
| *F21W 131/20* | (2006.01) |
| *F21Y 107/50* | (2016.01) |

(52) U.S. Cl.
CPC ..... *F21Y 2107/50* (2016.08); *F21Y 2115/10* (2016.08)

(56) References Cited

U.S. PATENT DOCUMENTS

| | | | | |
|---|---|---|---|---|
| 9,491,835 | B2 * | 11/2016 | Elfring | A61B 90/36 |
| 10,514,150 | B2 * | 12/2019 | Huang | F21S 8/00 |
| 2006/0221613 | A1 * | 10/2006 | Coushaine | F21K 9/00 257/E33.073 |
| 2008/0238323 | A1 | 10/2008 | Chan et al. | |
| 2009/0323330 | A1 * | 12/2009 | Gordin | F21V 11/00 362/249.02 |
| 2010/0157595 | A1 * | 6/2010 | Lin | F21K 9/00 362/249.02 |
| 2010/0195326 | A1 * | 8/2010 | Boxler | F21K 9/68 362/249.02 |
| 2010/0271829 | A1 * | 10/2010 | Laporte | F21V 13/04 362/308 |
| 2012/0320585 | A1 | 12/2012 | Lin et al. | |
| 2014/0218969 | A1 * | 8/2014 | Kjaer | F21V 29/51 362/249.02 |
| 2015/0146424 | A1 | 5/2015 | Karg et al. | |
| 2016/0097518 | A1 * | 4/2016 | Kim | F21V 14/02 362/233 |
| 2018/0184890 | A1 | 7/2018 | Stone et al. | |
| 2018/0228569 | A1 | 8/2018 | Strölin | |
| 2019/0183598 | A1 * | 6/2019 | Senelier | F21V 5/007 |
| 2021/0231291 | A1 * | 7/2021 | Yoshida | F21V 5/08 |
| 2022/0034480 | A1 * | 2/2022 | Tomimoto | F21V 5/045 |

FOREIGN PATENT DOCUMENTS

| | | | |
|---|---|---|---|
| JP | 2006156074 | A | 6/2006 |
| JP | 2008253744 | A | 10/2008 |

* cited by examiner

LIGHTING UNIT AND LUMINAIRE WITH SKEWED LED OPTICS PAIRS

CROSS REFERENCE TO RELATED APPLICATIONS

This application claims the benefit of priority under 35 U.S.C. § 119 of German Application 10 2021 108 309.5, filed Apr. 1, 2021, the entire contents of which are incorporated herein by reference.

TECHNICAL FIELD

The invention relates to a lighting unit (illumination unit) for a medical light with a number of groups of LEDs. Furthermore, the invention relates to a luminaire (lamp), in particular a medical luminaire (medical lamp), comprising at least one lighting unit according to the invention.

TECHNICAL BACKGROUND

It is known to equip a medical luminaire with a number of groups of LEDs arranged on a base body of the luminaire via a printed circuit board and to conduct heat away from the LEDs via this base body. The use of LEDs as light sources allows, for example, the color of the light fixture (luminaire) to be tanned and low heat generation. In addition, LEDs typically have a high power efficiency, require only a low voltage, are dimmable, and allow for a small light source size. Finally, LEDs are easy to arrange on printed circuit boards, making them very robust to install in typical applications.

With regard to the alignment of such LEDs, it is known to influence the light of a respective LED via an optical system assigned to the LED, for example to collect, focus and/or collimate it, and to determine the alignment of the optical system via the alignment of the assigned circuit board on which the LED is located. As is known, the circuit board rests on a corresponding base body so as to dissipate the heat generated.

For example, DE 10 2011 008 474 B4 describes a surgical light in which form-fit alignment of LEDs takes place along a multiple-bent circuit board to ensure particularly advantageous illumination in a light field of the light. In the medical context, such a light field is typically about 1 m away from the light.

SUMMARY

An object of the present invention is to provide a particularly advantageous lighting unit for a correspondingly advantageously configured luminaire, in particular a luminaire with a lighting unit that is particularly easy and inexpensive to manufacture.

According to the invention, a lighting unit for a medical light with a number of groups of LEDs is proposed to solve this problem.

This number of groups of LEDs is connected to a common planar printed circuit board, wherein each LED from at least one group from this number of groups is assigned a respective surrounding optic (adjacent optic interposed between diode and target), by which a respective LED-optic pair is formed. In this case, the respective optics, on the basis of its structure, specifies a tilt angle of a central light beam axis of an emitted light beam of the LED-optics pair in a tilt direction of the respective LED-optics pair, the tilt direction of the respective optics being defined in such a way that the respective light beam axes of the emitted light beams of the LED-optics pairs from the at least one group of LEDs are at least partially, in particular all, skewed in pairs with respect to one another.

Within the scope of the invention, it was recognized that by providing a suitable optical system, any desired courses of the light beam axes of LED optical pairs can be defined for advantageously illuminating the light field of a luminaire. For this purpose, the optics have a tilt angle and a tilt direction of the respective tilt angle of the central light beam axis. In this way, even a few different optics can ensure a particularly variable illumination in the light field distance from the corresponding luminaire according to predetermined characteristics.

For the purposes of the invention, a tilt angle means an angle not equal to 0°. Even taking into account any manufacturing tolerances, a tilt angle is therefore an angle of at least 0.1°.

According to the invention, the lighting unit represents a module for a luminaire in which all LEDs are connected to a common printed circuit board. The LEDs thereby form a number of groups of LEDs, wherein for at least one of these groups of LEDs the LED optics pairs according to the invention are formed, with the properties of the respective optics according to the invention. The at least one of the number of groups of LEDs comprises a plurality of LEDs. For this corresponding plurality of LED optics pairs, the corresponding light beam axes are at least partially, in particular all, skewed to each other in pairs.

In the context of the invention, skewed means that the light beam axes do not intersect in space and are not parallel to each other, even taking into account any manufacturing tolerances.

LEDs are known to emit light at a solid angle of up to 180°, so that the provision of an optical system results in a radiated light beam around a central light beam axis of this light beam. With mutually skewed light beam axes, the illumination of the light field can be adjusted in a particularly variable manner. For example, by aligning the optics, a light field diameter and the illumination depth can be adjusted and the light distribution within the light field can be set as desired.

In addition to the tilting angle caused by the respective optics, an additional tilting of the light beam axis may be caused, for example, by a tilting of the corresponding printed circuit board against a light axis provided within the respective luminaire. In addition to the printed circuit board, a mounting plate can also be provided for arranging a light guide that is connected to the corresponding LED. In this case, the surrounding optics are always arranged in the area of the optical output of the LED, which, in the case of a light guide used, may be spaced apart from the LED and thus spaced apart from the corresponding printed circuit board. Such a mounting plate can form an additional mounting level for the LEDs in addition to the printed circuit board connected to the LEDs.

Other LEDs not belonging to the at least one group of LEDs may, for example, be formed without surrounding optics or with optics without a corresponding tilt angle. Thus, the invention s that at least some LEDs, namely the LEDs from the at least one group of LEDs, can be particularly easily influenced with respect to their light beam axis via a corresponding structure of the surrounding optics in such a way that the tilt angle and the tilt direction lead to alignments that are skewed in pairs with respect to each other. In this way, a particularly individually configurable light field can be provided, in particular light can be directed to where it makes the best possible contribution to a desired light configuration and a desired overall light field.

Furthermore, the simple provision of a tilt angle can lead to the avoidance of a curvature and/or multiple bending of a printed circuit board for tilting light beams, which is costly to produce, as known from the prior art.

The use of a flat printed circuit board has the particular advantage that heat can be conducted away from the LEDs particularly efficiently and easily. This is necessary because LEDs heat up due to the lack of radiated heat. A corresponding thermal bridge can therefore be provided particularly easily via a base body that rests against the flat printed circuit board. In addition, the avoidance of a curved and/or multiply bent circuit board can lead to a more robust construction of the electronics and consequently to a longer service life of the lighting unit. Finally, the production of flat printed circuit boards is simpler and more cost-effective than the production of curved or multiple-bent printed circuit boards.

The structure of the respective optics, which determines the tilt angle and the tilt direction, comprises at least one optical element, such as a lens and/or a mirror, in such a way that a tilt angle unequal to 0° with respect to the light beam axis results. This can be achieved by an asymmetric structure of the optics, in particular of the optical element. Alternatively or additionally, this can be done by tilting the optical element relative to a normal direction of the printed circuit board and/or the mounting plate of the corresponding LED. Alternatively or additionally, this may be done by a diffraction structure, such as a diffraction grating, a prismatic structure, a free-form optic, a mirror optic, a gradient lens or a Fresnel lens or the like. There may also be an offset of the corresponding LED from the focal point of the optics or a combination of refractive, diffractive, reflective, nanostructured and/or microstructured optics. Particularly preferred for the implementation of the optics according to the invention is a TIR optic (Total Internal Reflection optic), which reflects the light in the outer region via the TIR structure and focuses it in the inner region as a lens. The skilled person in the field of optical systems is aware of a large number of possibilities for focusing light from an LED in a predetermined tilt direction, so that details of such structures will not be discussed below.

The surrounding optics are preferably attached via a fastening mechanism in the area of the corresponding LED. The fastening can then take place directly on the circuit board. For example, the optics can be fastened in the area of the corresponding LED by means of an adhesive bond, a plug-in connection, a screw connection, a form fit or the like.

Preferred embodiments of the lighting unit according to the invention are described below.

In a particularly preferred embodiment, the light beam axes of the LED optics pairs, which are skewed in relation to one another, each have different tilt directions in pairs. By adjusting a tilt direction, the provision of skewed light beam axes according to the invention can be implemented particularly easily in the manufacturing process.

In a particularly advantageous embodiment, each LED from the at least one group of LEDs is assigned an identically configured optic. This embodiment enables a particularly simple and inexpensive manufacturing process for the lighting unit, since different optics do not have to be provided. Thus, the same optics with the same tilt angle is used for the at least one group of LEDs, whereby only the orientation of this tilt angle along the tilt direction can differ from LED to LED within this group of LEDs. In this embodiment, the central aspect of the lighting unit according to the invention comes into play that a variably producible light field is possible at low cost on the common planar printed circuit board without a time-consuming tilting of printed circuit boards or adjustment of optical elements using identically configured optics. For this purpose, it must only be possible to set different tilt directions according to the invention, such as by means of different slots for the optics and/or a comparable fastening mechanism that enables different tilt directions.

In a further embodiment, at least one LED from the at least one group is associated with at least one further LED, which forms an LED cluster with the at least one LED, which generates a common light beam with light beam axis with the associated optics. By providing an LED cluster, different color tones, or color temperatures, and intensities can be provided, for example by different energization of the LEDs, which preferably have a different color temperature and whose light is combined by the optics. The optics thereby preferably surround not only the at least one LED from the at least one group of LEDs, but also the other LEDs within the common LED cluster. Preferably, the LEDs of an LED cluster can be controlled separately. The LED cluster is intended to provide a common light beam with a common light beam axis, so that a common surrounding optics is easily possible without additional configuration/structural hurdles.

In one embodiment, the fixable tilt direction is an orientation about an orientation angle within a mounting plane of the respective LED, in the direction of which the tilt angle of the pair of LED optics is oriented. Further, the tilt angle is an angle with respect to a surface normal to the mounting plane of the respective LED. Thus, the alignment angle within the mounting plane is an angle whose legs lie within the mounting plane. In this context, the alignment angle may be a rotation angle by which the optics must be rotated to set the predetermined tilt direction during a manufacturing process of the lighting unit. Setting the tilt direction and tilt angle with respect to the mounting plane of the respective LED makes it particularly easy to define light beam axes that are skewed with respect to each other in terms of configuration. The mounting plane can basically be formed by the printed circuit board if the LED optics pairs are arranged directly on the printed circuit board. Alternatively or additionally, the mounting plane can be formed by a separate mounting plate on which at least the optical output of the LED and/or of an LED cluster takes place.

In an advantageous and particularly preferred embodiment, the tilt direction can be fixed by means of a fastening mechanism, the fastening mechanism allowing the tilt direction to be reliably fixed by means of a discretely adjustable mounting of the optics via corresponding contact pins. The provision of contact pins is a particularly simple type of fastening that can be implemented cost-effectively as part of a manufacturing process that is preferably at least partially automated. The contact pins can thereby be arranged on the optics and/or on the fastening mechanism, for example on the printed circuit board. Preferably, the contact pins are thereby arranged asymmetrically with respect to a surface normal of the mounting plane. Such an asymmetrical arrangement may contribute to a torsion resistance of the correspondingly mounted optics and thereby support a robustness of the lighting unit. Preferably, slots corresponding to the position of the contact pins are provided on the printed circuit board such that a predetermined tilt direction for the corresponding optics is provided by inserting the contact pins into the slots. Alternatively or additionally, the contact pins on the printed circuit board can be provided in accordance with the position of the slots on the optics in such a way that the insertion of the contact pins into the slots results in a predetermined tilt direction for the corresponding optics. Alternatively to the two preceding examples, according to the invention corresponding slots for the contact pins may allow different possible assignments between contact pin and slot. This allows for different tilt directions for the respective LED optic pair. By providing contact pins, a discrete change of the tilt directions in preferably at least four different tilt directions, in particular at least eight different tilt directions, is possible. The attachment of the optics via contact pins and corresponding slots represents a particularly robust and easy-to-provide type of attachment, which can also be reliable in everyday clinical use after jerky movements of the corresponding lighting unit. Preferably, such a fastening mechanism is supported by an integral and/or non-positive connection, such as adhesive bonding or pressing.

In a further embodiment, the tilt direction can be fixed via a fastening mechanism, the fastening mechanism comprising in each case a rotatable mounting of the optics, in particular a rotatable mounting of the optics on the common printed circuit board. By means of the rotatable mounting of the optics, the tilt directions can be set particularly conveniently during the manufacturing process of the lighting unit, preferably continuously. Such a rotatable mounting can be possible, for example, by means of a form fit of the optics to the mounting mechanism. Preferably, an axis of rotation of the rotatable bearing runs through a center of the respective pair of LED optics. This enables a uniform rotation of the light beam axis about the axis of rotation by rotating the optics.

In the context of the invention, a fastening mechanism is a structure that enables a form-fit, force-fit and/or material-fit connection between the optics and the printed circuit board or the mounting plate. Preferably, the fastening mechanism is formed by an optics-side structure and a board-side structure that cooperate with each other to provide the connection.

In a further embodiment, the tilt direction and/or an amount of the tilt angle of at least one optic is adjustable, in particular mechanically or electrically adjustable. Such a control of the tilt directions and/or the amount of the tilting angle enables a dynamic adjustment of the light field. Preferably, an adjustment takes place via an electrical signal which is triggered by a user via a user interface. An example of an adjustability according to the present embodiment represents the electrical control of a liquid lens or a motor of the adjustable optics. Alternatively or additionally, an adjustable bearing, for example via a swivel joint or a screw connection, is possible, which can be manually adjusted by the tilt directions and/or the amount of the tilt angle.

The surrounding optic according to the invention is preferably formed from a plastic. Particularly preferably, the surrounding optic is manufactured by an injection molding process. Alternatively, other suitable manufacturing processes are known, such as injection stamping, expansion stamping, embossing, casting, diamond turning or diamond milling, grinding and polishing, 3D printing, at least partial vapor deposition with metallic or dichroic mirror layers and/or other known manufacturing processes for plastic optics, glass optics or mirrors.

According to a further aspect of the invention, a luminaire, in particular a medical luminaire, comprising at least one lighting unit according to at least one of the preceding embodiments is proposed for solving the above task. In this regard, the luminaire has a central luminaire axis, wherein a light field of the luminaire is generated in a plane perpendicular to the luminaire axis at the light field distance from the luminaire by the light of the at least one lighting units.

The luminaire according to this further aspect of the invention comprises the lighting unit according to the invention and consequently also all the advantages described for this lighting unit.

In the medical environment, the light field distance is typically a predetermined distance, which in this case is preferably between 0.4 m and 1.5 m, and particularly preferably in the range of 1 m. Operating room lights typically have a light field distance of about 1 m. Examination lights typically have a light field distance of about 0.5 m. Luminaires within the meaning of the invention can be, for example, operating theater luminaires or examination luminaires.

Preferably, the lighting unit according to the invention is a component that can be easily inserted into the luminaire according to the invention. Such a modular configuration enables a particularly simple manufacturing process for the luminaire. Particularly preferably, several lighting units according to the invention can be inserted into the luminaire according to the invention. In a particularly advantageous variant of this embodiment, the luminaire has suitable receptacles into each of which the corresponding lighting unit can be inserted. By providing a connection area, the receptacle ensures an electrical connection of the respective printed circuit board of the lighting unit with an electronic system of the luminaire according to the invention. Preferably, the receptacle also ensures a large-area, form-fitting and thermally conductive contact surface at least to areas of the planar printed circuit board near a respective LED for heat dissipation. The attachment via the receptacle defines a mechanical alignment, i.e. a tilting, of the planar circuit board relative to the luminaire and the luminaire axis. A modular configuration also enables the use of different lighting units according to the invention for the luminaire according to the invention, for example depending on a planned use scenario of the luminaire, such as a planned medical operation.

The connection between the lighting unit and a luminaire housing of the luminaire can be realized, for example, via a screw connection. In this case, drill holes can be provided in the respective printed circuit board of the corresponding lighting unit that match the screw thread provided. Alternatively or additionally, a latching mechanism can be provided for inserting the lighting unit into the luminaire.

By means of the lighting unit according to the invention, the light field of the luminaire can be specified and/or adjusted in a particularly simple and cost-effective manner via the respective optics according to the invention for the corresponding LED optics pairs, in particular during a manufacturing process of the luminaire.

In a preferred embodiment, a large number of light beam axes of the LED optics pairs are skewed relative to the luminaire axis. In this way, characteristic properties of the light field, such as the light field diameter, an intensity distribution within the light field, the illumination depth, the shadowing and the like, can be specified in a particularly variable manner by predetermining different tilt directions. Particularly preferably, at least 10% of the light beam axes of the LED optical pairs are formed to be skewed with respect to the luminaire axis. Alternatively or additionally, at most 90% of the light beam axes of the LED optics pairs are skewed relative to the luminaire axis.

In a preferred embodiment, the luminaire according to the invention comprises a plurality of identically configured lighting units according to at least one of the embodiments relating thereto. Such a luminaire enables particularly simple manufacture, since it is not necessary to differentiate between different lighting units during assembly. Another advantage of this embodiment is the reduction to preferably only one type of identical lighting units to be manufactured. This enables a particularly simple and inexpensive manufacturing process. Finally, the use of identical lighting units can lead to a substantially symmetrical arrangement of emitted light beams and thus to a symmetrical illumination of the light field.

In a further advantageous embodiment, the luminaire according to the invention comprises a plurality of lighting units according to at least one of the related embodiments, wherein the lighting units are arranged rotationally symmetrically with respect to the luminaire axis. In a preferred variant of this embodiment, the lighting units from the plurality of lighting units are substantially identically formed. The rotationally symmetrical arrangement of lighting units can advantageously support a uniform illumination of the light field.

In an advantageous embodiment, the luminaire according to the invention comprises a plurality of lighting units according to at least one of the related embodiments, wherein the LED optical pairs of a respective lighting unit are arranged on a planar printed circuit board different from a planar printed circuit board of another lighting unit. The provision of different planar circuit boards may, for example, support a modular configuration of the lighting fixture. In addition, the provision of different printed circuit boards may enable a particularly simple structure of the electronics of the luminaire according to the invention. In a preferred variant of this embodiment, at least two different printed circuit boards of the lighting units of the luminaire are tilted relative to each other by a board tilt angle. Via such a plate tilt angle, a tilting of LED optics pairs against each other can be realized, so that the tilt angle of a single LED optics pair realizes only a subordinate tilting against the plate tilt angle. For example, if the goal is to tilt an LED-object pair by an angle of 11.5° against a plane perpendicular to the luminaire axis, a tilt angle of 11° against this plane can result in the tilt angle of the individual LED-optic pair only having to be 0.5°. How large the plate tilt angle between two printed circuit boards must be to provide such an angle of inclination depends on the specific luminaire geometry and is immediately apparent to the person skilled in the art. This preferably allows for a particularly symmetrically emitted light beam compared to very large tilt angles, which typically result in a large optical aberration, an asymmetric beam, and poorer light collection from edge regions of the light beam away from the intended tilted light beam axis. Providing the angle of inclination is particularly advantageous if a specific range of tilt angles, for example between 9° and 13°, with respect to the plane perpendicular to the luminaire axis is provided for the LED optic pairs. Thus, for the given example, an angle of inclination of 11° can be set, and the tilt angles of the respective optics need only be between 0.1° and 2°. In this case, therefore, different optics would preferably be provided. An example of this interaction between the angle of inclination of the printed circuit board and the tilt angle of the optics is described in FIG. 2.

An LED optic pair which does not have a tilt angle due to the selected structure of the luminaire, for example due to an angle of inclination, does not belong to the at least one group according to the invention from the number of groups in which the respective optic specifies a tilt angle. In this sense, according to the invention, in addition to the LED optics pairs from the at least one group of LEDs, there can also be LED optics pairs from another group with other properties and other optics, in particular optics without a tilt angle.

In a preferred embodiment, the luminaire comprises at least two different optics that differ at least in the tilt angles specified by the respective optics. The provision of a number of different tilt angles advantageously enables a particularly detailed definable light field of the luminaire. In particular, optics with different tilt angles enable areas of the luminaire, such as areas of the luminaire arranged in a ring around a luminaire center, which each have optics with a single predetermined tilt angle and preferably different tilt directions.

In a preferred embodiment, LED optics pairs with an equal distance from the luminaire axis have a respective light beam axis which form angles with a perpendicular line from the position of the respective LED to the luminaire axis with a substantially equal amount. By means of such LED optical pairs, ring-shaped areas of the luminaire can be formed which are particularly suitable for achieving functions in the light field and/or a light field adjustment by individual energization of these LEDs. Such a light field adjustment can be, for example, a change of the light field diameter, the light field shape, the light field distance and/or the light field color.

In a particularly preferred embodiment, the luminaire further comprises a control unit configured to drive at least one subgroup of LEDs from the at least one group of LEDs from the at least one lighting unit separately from other LEDs from the corresponding group of LEDs outside this subgroup. The driving may, for example, change a light output, an intensity, a color, or an on/off state of the correspondingly driven subgroup of LEDs. Such a change is advantageously performed, for example, for all LEDs from the subgroup of LEDs simultaneously.

The invention will now be explained in more detail with reference to advantageous examples of embodiments shown schematically in the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
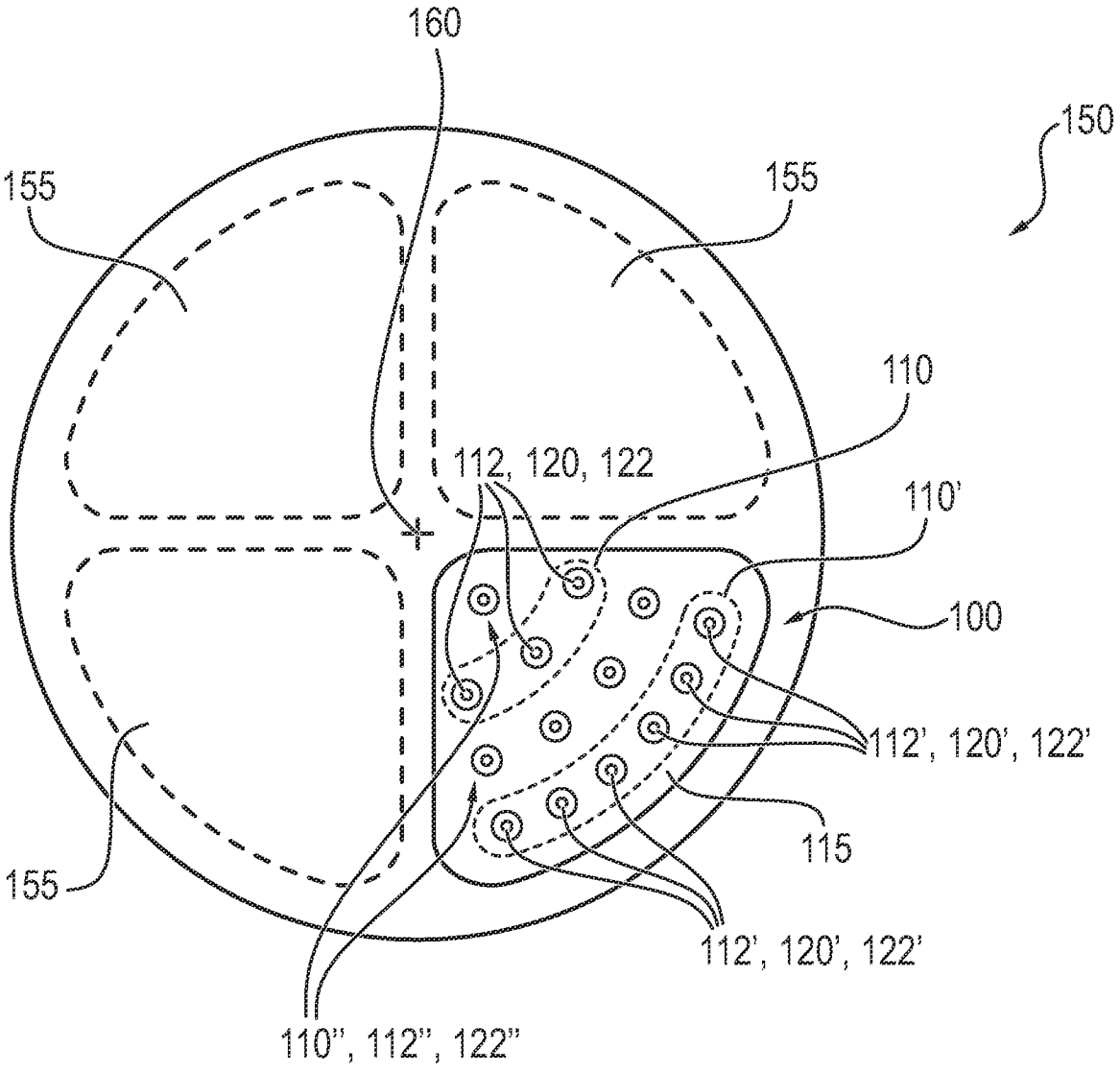
FIG. 1 is a schematic view of a first embodiment of a lighting unit according to the invention for a first embodiment of a luminaire according to a further aspect of the invention.

Referring to the drawings, FIG. 1 shows a schematic representation of a first embodiment of a lighting unit 100 according to the invention for a first embodiment of a luminaire 150, in particular a medical luminaire 150, according to a further aspect of the invention.

The lighting units 100 comprise a number of groups of LEDs 110, 110', 110", namely three groups of LEDs in the present case. The LEDs of the group 110, 110' have in the present case approximately the same distance from a central luminaire axis 160 of the luminaire 150, which intersects the display plane perpendicularly. The remaining LEDs form the third group 110". Each of the groups of LEDs 110, 110', 110" is connected to and arranged entirely on a common planar circuit board 115 of the lighting units 100. In an alternative embodiment, the optical outputs of LEDs are at least partially arranged on a mounting plate that is at least connected to the printed circuit board 115, as shown for example in FIG. 4.

Each LED 112, 112' from at least one group 110, 110' from said number of groups is associated with a respective surrounding (adjacent interposed) optic 122, 122' by which a respective LED optic pair 120, 120' is formed. In the illustrated embodiment, each group of LEDs 112, 112', 112" from the number of groups of LEDs 110, 110', 110" has a respective surrounding optic 122, 122', 122". However, only the groups 110, 110' according to the invention have LED optics pairs 120, 120' in which the respective optics 122, 122' have a tilt angle in one tilt direction due to their structure. This structure of the optics is described in the context of the following embodiment example.

Also shown in dashed lines in FIG. 1 are three areas of receptacles 155 into which further lighting units, such as a lighting unit identical in construction to the illustrated lighting units according to the invention, can be inserted. The receptacles 155 preferably have a connection area which ensures an electrical connection between a remaining part of the luminaire 150, such as a luminaire electronics in the luminaire housing, which is not shown, and the lighting units to be inserted. For this purpose, the lighting units also have an electrical connection that is not shown, so that an electronic system of the luminaire is connected to the LEDs 112, 112', 112" of the lighting units 100 via the printed circuit board 115. The insertion of the respective lighting unit into the corresponding receptacle 155 is preferably performed via a positive and/or non-positive connection, in particular via a snap-in mechanism. Alternatively or additionally, the fastening after an insertion can be carried out via screws, whereby a homogeneous contact to a base body and consequently a good heat flow can be provided in a particularly simple manner.

In the illustrated embodiment, the luminaire 150 is round, in particular circular, when viewed from below, i.e. from the illuminated area. In an embodiment not shown, the luminaire is elliptical or angular, in particular in the form of a regular n-gon. Particularly preferably, the luminaire is point-symmetrical with respect to the luminaire axis when viewed from below, for example flower-shaped, star-shaped or satellite-shaped.

The receptacles allow the luminaire 150 to comprise a plurality of identically configured lighting units. This plurality of lighting units can be arranged rotationally symmetrically with respect to the luminaire axis 160 in accordance with the receptacles 155.

According to the lighting units 100, each lighting unit would provide a separate dedicated printed circuit board 115 for electrically connecting the LEDs to the luminaire's electronics, which are not shown. Alternatively or additionally, the electronics or portions of the electronics for operating the LEDs may already be included on the corresponding planar circuit board. For example, LED drivers may be included on the printed circuit board. Preferably, only the electronics for a power supply and a control unit of the luminaire are outside the lighting unit.

By means of such a modular structure, different lighting units can be combined with each other. In addition, the modular structure can provide differently shaped luminaires according to the invention, such as luminaires with a different number and/or orientation of the lighting unit according to the invention.

Figure 2:
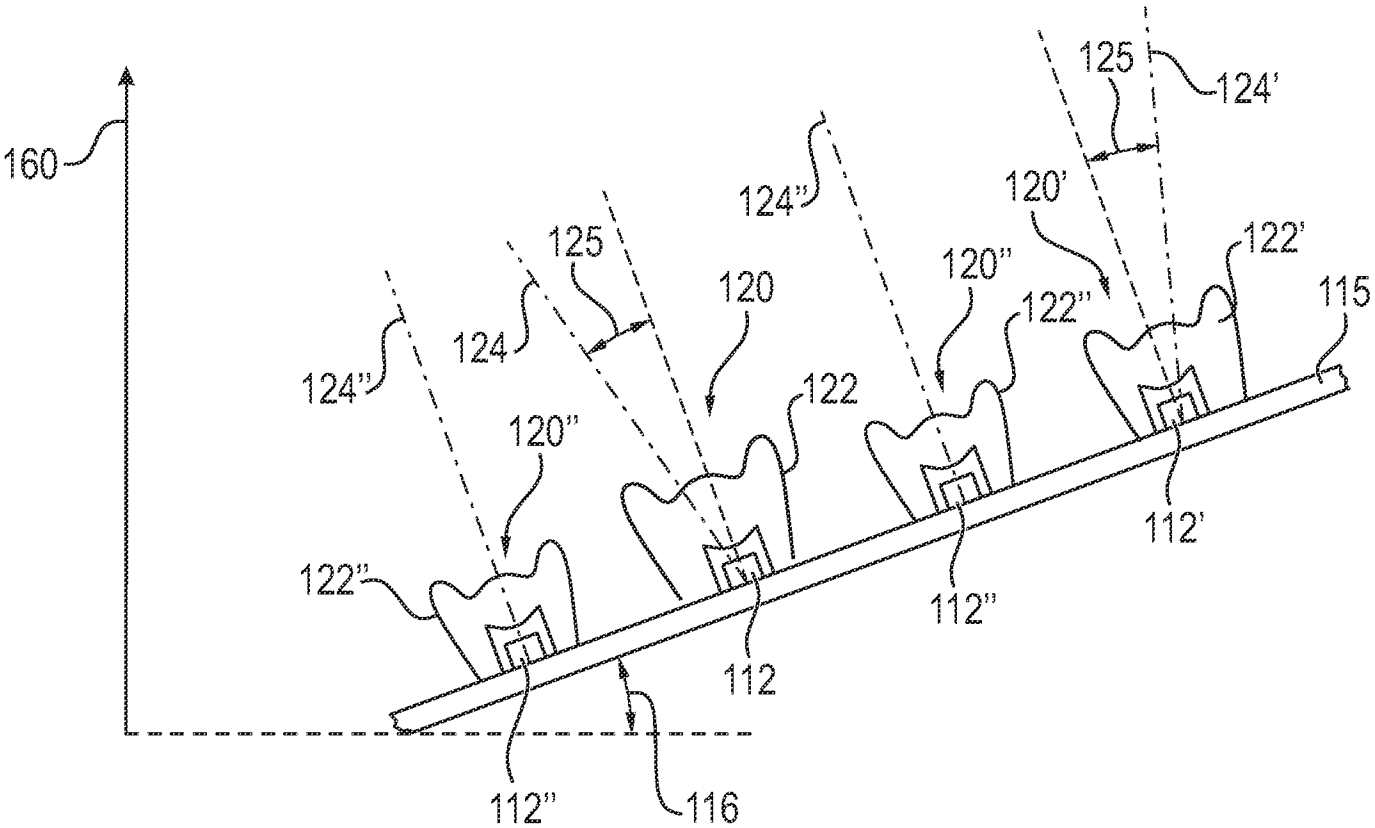
FIG. 2 is a cross-sectional view of various LED optical pairs of the first embodiment of the lighting unit according to the invention.

FIG. 2 shows a cross-sectional view of various LED optical pairs 120, 120', 120" of the first embodiment of the lighting unit 100 according to the invention.

The respective surrounding optics 122, 122', 122" define a central light beam axis 124, 124', 124" of an emitted light beam of the corresponding LED optics pair 120, 120', 120" due to their shape. A light beam is formed by rays that extend essentially along the light beam axis and form a divergence angle with the light beam axis in the outer region of the light beam, which depends on the geometry of the optics used and on manufacturing tolerances. Here, the light beam axes 124" of the third group of LEDs 112" do not have a tilt angle, but are aligned along the surface normal on the mounting plane, which in the present case is aligned along the printed circuit board 115. The two central light beam axes 124, 124' of the LED optic pairs 120, 120' according to the invention have a tilt angle 125 against the surface normal of the mounting plane, which is the same for both LED optic pairs 120, 120', but is oriented in different tilt directions. Thus, the light beam axis 124 of the LED optic pair 120 of the first group of LEDs 110 is oriented toward the center of the luminaire 150. In contrast, the light beam axes 124' of the pair of LED optics 120' of the second group of LEDs 110' is oriented toward an edge region of the luminaire 150. Other orientations not shown between these two opposite tilt directions are possible according to the invention, as shown for example in FIG. 6. In this case, the light beam axes 124, 124' do not run exactly in the plane of representation. The different tilt directions are selected in such a way that the light beam axes 124, 124' have such different tilt directions into the display plane that both are skewed to each other, i.e.

do not intersect along the straight line on which the respective light beam axes 124, 124' lie.

Figure 4:
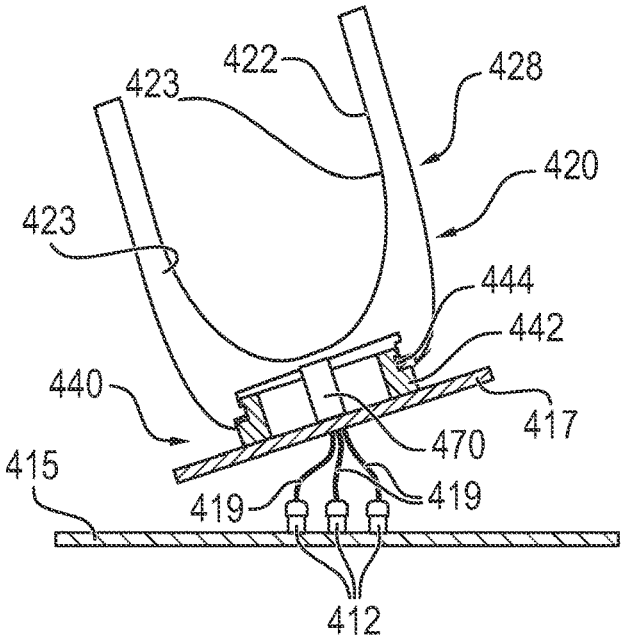
FIG. 4 is a cross-sectional view of an embodiment of a pair of LED optics, with another of different structures of an adjacent optic and with one of different attachment mechanisms.
Figure 5:
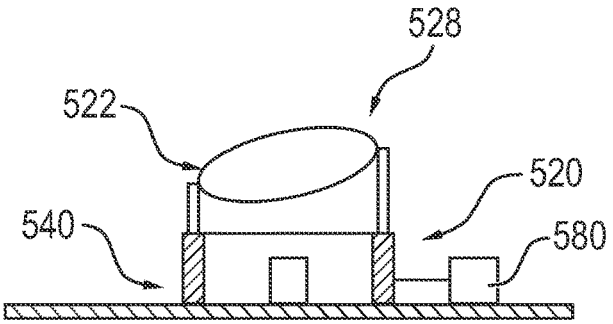
FIG. 5 is a cross-sectional view of an embodiment of a pair of LED optics, with another of different structures of an adjacent optic and with one of different attachment mechanisms.

In the embodiment shown, the respective surrounding optics 122, 122', 122" each have a lens-shaped central region which, together with the rest of the optics, forms a so-called TIR optic (Total Internal Reflection optic) which aligns the undirected emitted light of the respective LED into light beams along the corresponding light beam axes 124, 124', 124". Such a TIR optic comprises a central refractive region, formed for example by a lens, and a reflective edge region. Alternative embodiments are shown in FIGS. 4 and 5.

In addition to the tilt angle of the corresponding light beam axes 124, 124', there is an angle of inclination 116 with respect to a plane perpendicular to the luminaire axis 160 by which the printed circuit board is tilted. In the illustrated embodiment example, this angle of inclination 116 is between 4° and 20°, in particular between 8° and 14°, preferably approximately 11°. The different tilt directions of the two optics 122, 122' therefore result in two different tilting angles of the corresponding light beam axes with respect to the luminaire, which have an identical angular distance from the angle of inclination 116. Thus, according to the invention, by using the same optics but different tilt directions of the corresponding predetermined tilt angle, different tilt angles can be provided for the light field of the luminaire. By providing an additional angle of inclination 116 by which the printed circuit board is tilted, an angle band can be set accordingly by adjusting the tilt directions, which can vary between the angle of inclination minus the tilt angle of the corresponding optics and the angle of inclination plus the tilt angle of the corresponding optics. Thus, according to the invention, with only one optical component to be manufactured, namely an optic with a predetermined tilt angle, a multitude of possible tilt angles of the corresponding light beam axes with respect to the luminaire is made possible.

In addition to the tilting angle of the corresponding light bundle axes 124, 124', there is an angle of inclination 116 relative to a plane perpendicular to the luminaire axis 160, about which the printed circuit board is tilted. In the exemplary embodiment shown, this angle of inclination 116 is between 4° and 20°, in particular between 8° and 14°, preferably approximately 11°. The different tilt directions of the two optics 122, 122' therefore result in two different tilting angles of the corresponding light beam axes with respect to the lamp, which are at an identical angular distance from the angle of inclination 116. Thus, according to the invention, different tilt angles can be provided for the light field of the lamp by using the same optics but different tilt directions of the corresponding predetermined tilt angle. By providing an additional angle of inclination 116 by which the printed circuit board is tilted, an angle band can be adjusted by adjusting the directions of tilt, which can vary between the angle of inclination minus the tilt angle of the corresponding optics and the angle of inclination plus the tilt angle of the corresponding optics. Thus, according to the invention, with only one optical component to be produced, namely an optic with a predetermined tilt angle, a multiplicity of possible tilt angles of the corresponding light beam axes with respect to the lamp is made possible.

In other embodiments, at least two different optics are provided for the luminaire according to the invention, which differ at least in their tilt angle.

Various exemplary embodiments for mounting the corresponding optics to form the pair of LED optics according to the invention are shown in the following embodiments.

Figure 3:
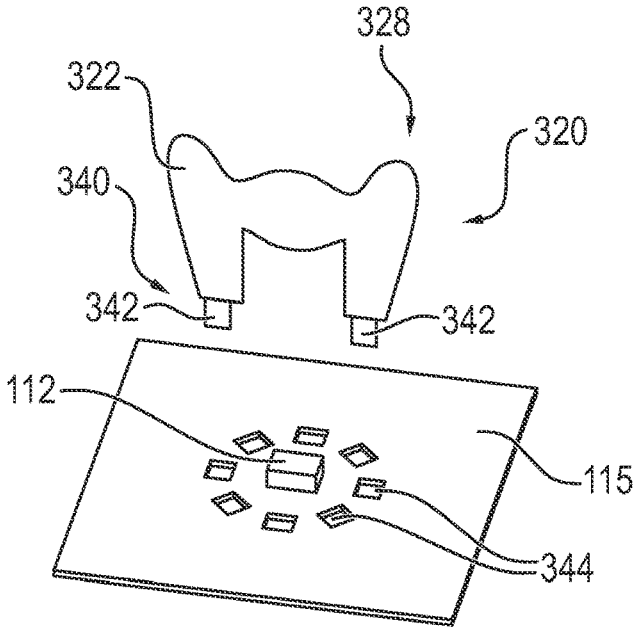
FIG. 3 is a cross-sectional view of an embodiment of a pair of LED optics, with one of different structures of an adjacent optic and with one of different attachment mechanisms.

FIGS. 3, 4, and 5 show a cross-sectional view of a respective embodiment of a pair of LED optics 320, 420, 520 with various structures 328, 428, 528 of a surrounding optics 322, 422, 522 and with various attachment mechanisms 340, 440, 540.

FIG. 3 shows a TIR optics 322 with a tilting of a central lens-shaped area, as it is basically already shown in FIG. 2. For clarity, the optics are shown in cross-section, while the printed circuit board is shown in perspective. The angle by which the geometry of the optics is tilted correlates with the tilt angle provided by the optics, but is not necessarily identical to it. However, the attachment mechanism 340 for attaching the optic 322 to the circuit board 150 is additionally shown here. Thus, the optic 322 has at least two contact pins 342, preferably three contact pins, each of which can be inserted into one of the available slots 344 on the circuit board 115 to surround the LED 112 disposed on the circuit board 115. Providing at least three contact pins may further increase a resistance to rotation of the optics. By providing different slots 344, different tilt directions of the tilt angle of the optic 322 can be specified. Due to the discrete provision of slots 344, a discrete predetermined number of different tilt directions for the illustrated LED optic pair 320 can be defined, in particular can be defined during the manufacturing of the light fixture (luminaire). Alternatively, the intended tilt direction can already be taken into account during the manufacture of the printed circuit board, so that the slots corresponding to the intended location for the contact pins are provided only for this tilt direction. This avoids errors in the manual attachment of the optics during manufacture.

FIG. 4 shows an optical system 422 which, due to a mirror 423, preferably a parabolic mirror, an aspherical mirror and/or a free-form mirror, emits the light of the corresponding LED 112 along a predetermined light beam axis with a predetermined tilt angle. To provide a tilt angle, the mirror is preferably asymmetric.

The mirror 423 is attached to the mounting plate 417 via an attachment mechanism 440. In the present case, the mounting mechanism 440 comprises an annular part 442 with a groove 444 in which the corresponding optics can engage, so that a mounting is effected via an engagement of the optics 422 in the annular part 442. Alternatively, a commercially available LED optics socket may also result in attachment of the optics within the lighting unit according to the invention. Preferably, in the illustrated embodiment, the mounting mechanism 440 allows the optics to be rotatably mounted so that different tilt directions for the LED optics pair 420 can be continuously established.

In addition, FIG. 4 shows that the mounting plate 417 may be different from the circuit board 415. For example, in the illustrated embodiment, the LEDs 412 are arranged on the circuit board 415, and optical fibers 419 are used to direct the light to the corresponding optical output 470 on the mounting plate 417. In an embodiment not shown, the angle between the mounting plate and the circuit board is adjustable via a control unit of the light fixture (luminaire).

In this case, the LEDs 412 form an LED cluster that generates a common light beam with a light beam axis via the associated optics 422. Alternatively, the light of the LED cluster can be mixed in a single light guide. As is known, a light guide rod or the like can be used for this purpose.

FIG. 5 shows an optic 522 formed by a tilted lens with an asymmetric mount. The asymmetric mount is bonded to the printed circuit board so that the mounting mechanism 540 is formed over a planar bonded portion of the mount. In this regard, the optics 522 can be controlled by an adjustment unit 850 and thereby rotated upon receiving a corresponding signal. In the illustrated embodiment, the asymmetric mount is further adjustable via the adjustment unit 850. In this regard, the tilt of the lens can be changed. Rotation and tilting are performed mechanically via a motor, which is not shown and is controlled via the adjustment unit 580.

Figure 6:
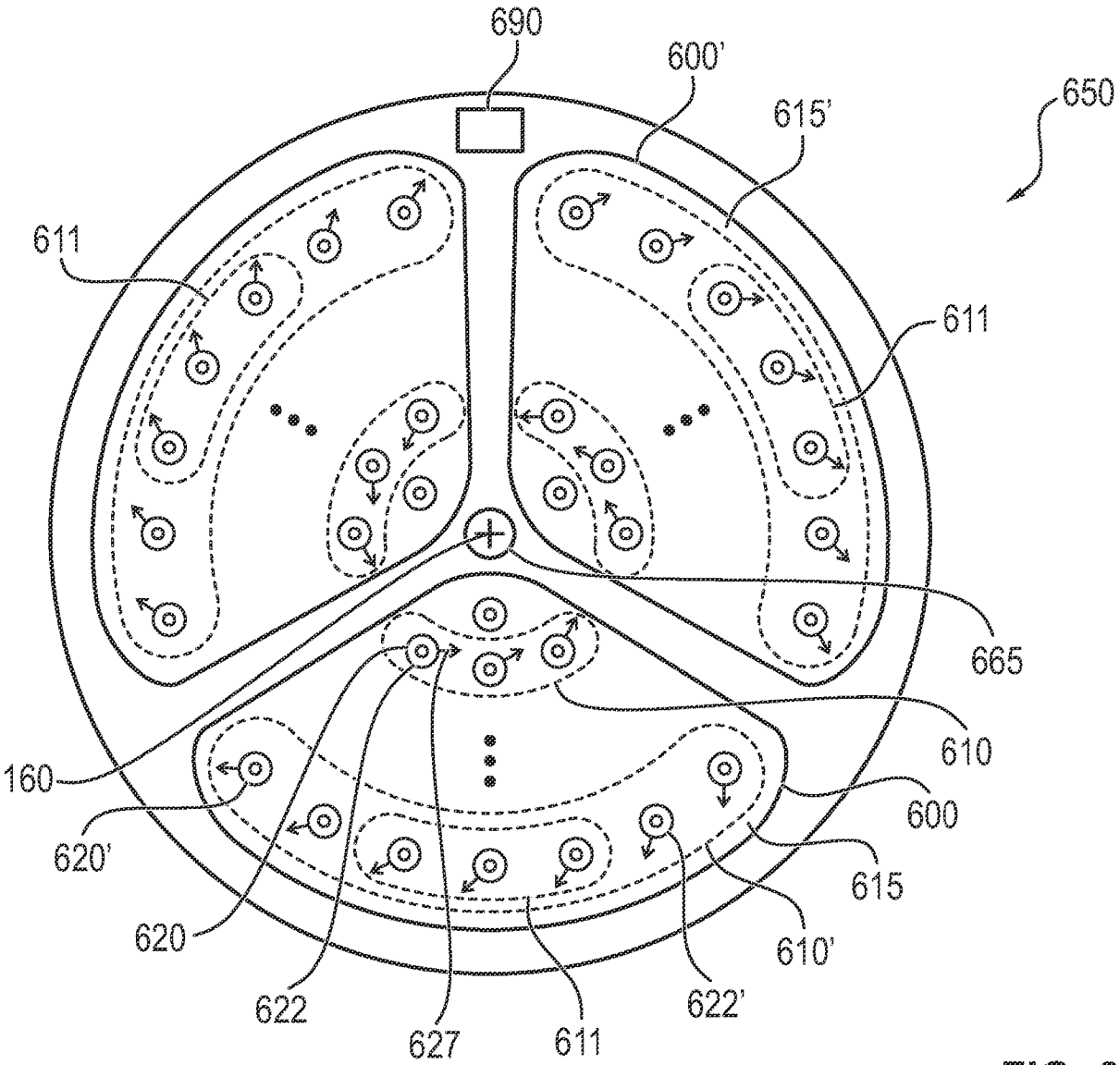
FIG. 6 is a schematic view of a second embodiment of the lighting unit according to the invention for a second embodiment of the luminaire according to the further aspect of the invention.

FIG. 6 shows a schematic representation of a second embodiment of the lighting units 600 according to the invention for a second embodiment of the luminaire 650 according to the further aspect of the invention, as viewed from the light field along the luminaire axis.

Figure 7:
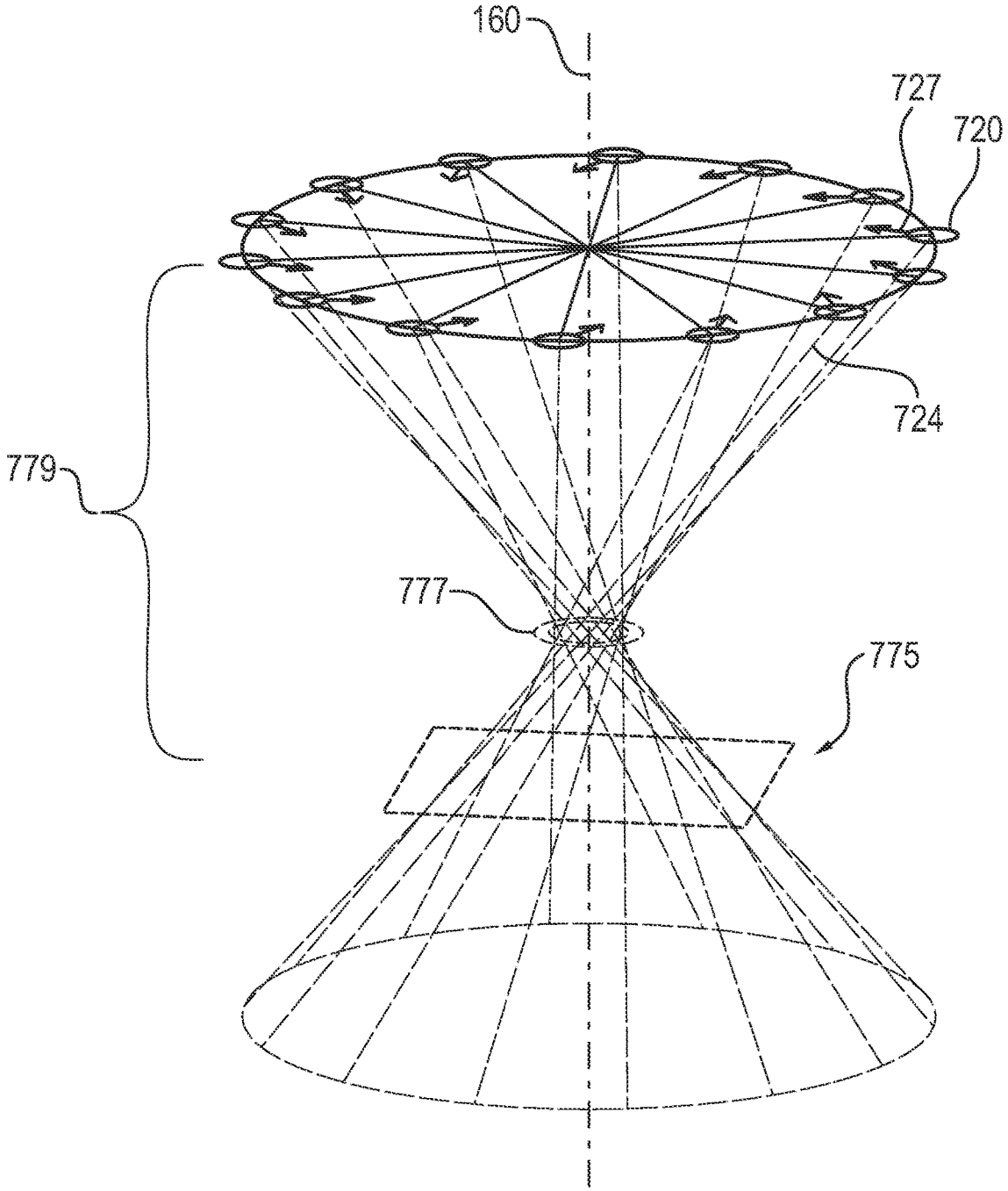
FIG. 7 is a schematic view of light beam axes and a corresponding light field of the luminaire according to a further embodiment.

The lighting unit 600 differs from the lighting unit 100 of FIG. 1 in that more LEDs 612 are provided, and these LEDs can be controlled in groups via a central control unit 690 of the luminaire 650. Of the LEDs shown, at least two groups of LEDs 610, 610' are provided in each of the three identically shown lighting units 600 with LED optical pairs 620, 620' according to the invention. For clarity, the features of a respective lighting unit are shown for only one lighting unit 600. These have a tilt angle not shown in FIG. 6 and in each case a tilt direction 627 indicated by a respective arrow on the LED optics pair 620, 620' in the illustration, which is different for the LED optics pairs even within a group of LEDs 610, 610'. The tilt direction 627 is here the direction within the mounting plane of a respective LED in which the tilt angle of this LED is aligned. This interaction of tilt angle and tilt direction has already been explained in the context of FIG. 2 and is shown in more detail in FIG. 8. In particular, the corresponding light beam axes of the respective LED-optic pairs, which are not shown, are formed at an angle to each other. In particular, the LED-optic pairs with an equal distance from the luminaire axis 160 have a respective light beam axis that forms a respective angle with a perpendicular line from the position of the respective LED to the luminaire axis with a substantially equal amount. This alignment also results in the amount of the angle of the perpendicular lines being substantially equal with the tilt directions. An exemplary arrangement of the light beam axes for a similar alignment of the tilt directions is shown in FIG. 7.

A handle 665 of the light 650 is also arranged in the area of the light axis 160, which is configured to adjust the position of the light 650 during use, for example in the operating room.

The control unit 690 is configured to control at least one subset 611 of LEDs from the at least one group of LEDs 610, 610' from the at least one lighting unit 600 separately from other LEDs from the corresponding group of LEDs 610, 610' outside of that subset 611.

Alternatively or additionally, the groups of LEDs 610, 610' can also be controlled differently, whereby, for example, a light output, an intensity, a color, a color temperature or an on/off state of the correspondingly controlled subgroup 611 of LEDs can be changed via the control.

By such a group-wise control and/or by a control of subgroups of LEDs from a group of LEDs according to the invention, a particularly advantageous illumination of the light field by the luminaire according to the invention with the lighting unit according to the invention can be ensured, such as, for example, a preferred light field diameter, a preferred light field shape, a preferred color temperature of the light field, a preferred shading, a preferred radial intensity profile of the light and the like. Here, in particular, annular regions of homogeneous light intensity can be provided by the groups of LEDs 610, 610' according to the invention.

Preferably, the tilt angles of the illustrated groups of LEDs are essentially the same. Alternatively, in addition to the selection of respective tilt directions, the groups of LEDs 610 and 610' differ in the tilt angle, which is not shown. In the present case, the optics 622 of the group 610 differ from the optics 622' of the other group 610' in the respective tilt angle.

The lighting units 600, 600' of the luminaire 650 are identically formed. In this regard, the circuit boards 615, 615' of the lighting units 600, 600' form separate circuit boards 615, 615' that are tilted relative to one another by a board tilt angle that is not shown in the illustrated embodiment.

FIG. 7 shows a schematic representation of light beam axes 724 and a corresponding light field 775 of the lamp according to the invention, which is not shown, according to a further embodiment.

In the illustrated embodiment, the orientation of the tilt angles of the respective LED optics pairs 720, which is identical to luminaire axis 160, results in a saddle region 777 that is particularly narrow compared to the extent of the present luminaire.

The luminaire according to the invention can advantageously provide a large radiation intensity for the light field in a distance range around the light field distance 779. A point-like alignment of the light beam axes to a point would cause the intensity to drop sharply around this point. This effect can be avoided by the ring-shaped illumination shown. In this case, different groups of LED optics pairs can provide different annular areas of illumination, thereby advantageously providing a large area with a large intensity in the area of the light field compared to the light field edges. The light field distance 779 is advantageously between 80 cm and 1.30 m, in particular between 90 cm and 1.10 m, particularly preferably about 1 m. The light field 775 is preferably located at the saddle area 777 or in a neighborhood of the saddle area 777.

The orientation of the tilt directions 727 is similar to the orientation of the tilt directions 627 of the group of LEDs 610 of FIG. 6, namely such that LED optic pairs 720 having an equal distance from the luminaire axis 160 have a respective light beam axis 724 that forms a respective angle with a perpendicular line from the position of the respective LED to the luminaire axis 160 with a substantially equal amount. The annular region of illumination thus formed in the area of the light field 775 is substantially defined by the tilt directions 727 and the corresponding tilt angle of the substantially equal LED optical pairs 720.

In addition to the exemplary group of LEDs shown, other groups of LEDs may correspondingly result in other annularly illuminated areas in the vicinity of the light field 775. Here, a control unit preferably allows the respective group of LEDs and/or a respective subgroup of the group of LEDs to be controlled so that properties of the current illumination by the luminaire can be controlled, for example temporarily controlled.

Figure 8:
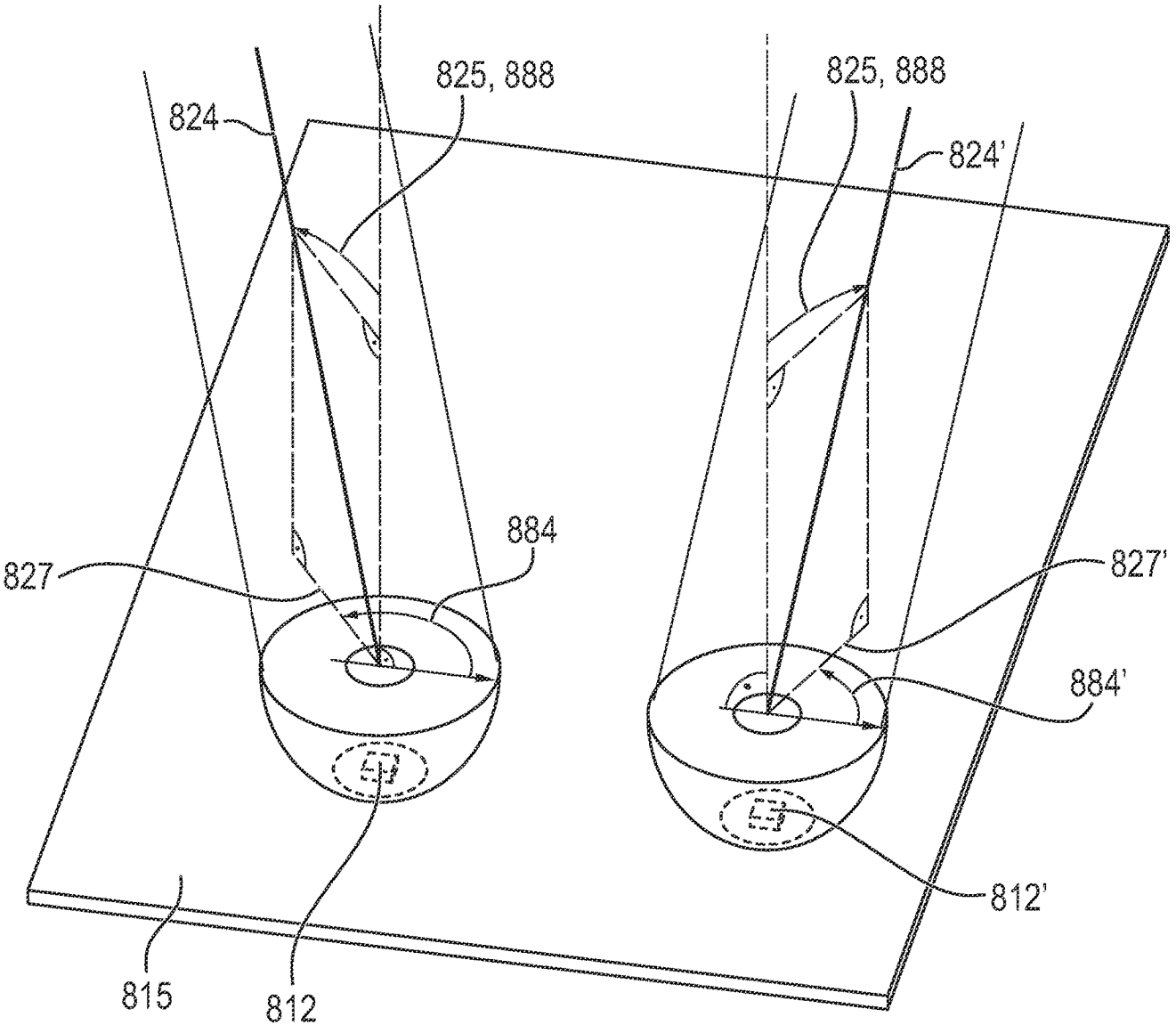
FIG. 8 is a schematic view of the tilt angle and tilt direction of two pairs of LED optics according to the invention.

FIG. 8 shows a schematic representation of tilt angle 825 and tilt direction 827, 827' of two pairs of LED optics according to the invention. The explanations for this illustration are fundamental to the present invention and therefore apply analogously to all embodiments and embodiments.

The LEDs 812, 812' are arranged on a printed circuit board 815 according to the invention. The optics of the two LED optics pairs shown are identical in construction and therefore have the same tilt angle 825. However, the two optics differ in their orientation and thus in their tilt directions 827, 827'.

Both LED optics pairs each emit a light beam with a light beam axis 824, 824', which are skewed to each other and have angles in space have angles in space relative to the printed circuit board normal. These angles lying in space can be described in spherical coordinates. This is to explain the terms tilt direction and tilt angle in the sense of the present invention. For the description in spherical coordinates, the plane formed by the printed circuit board 815 is displaced parallel to the respective center of the light emission plane of the optics, which represents the equatorial plane, and the corresponding surface normal through the center of the LED 812, 812' represents the polar axis for this purpose. The solid angles of the light beam axes 824, 824' can then be described by an azimuth angle 884, 884' (longitude) and a polar angle 888 (latitude). If both use the same optics, they therefore also have the same polar angle 888, i.e. in the sense of the invention the same tilt angle 825. Tilt angle 825 and polar angle 888 are therefore identical in the sense of the invention. This tilt angle 825 is a property of the optics. An additional degree of freedom results from a rotation of the optics about the polar axis, i.e. about the printed circuit board normal by the azimuth angle 884, 884', which preferably has to be carried out during the mounting of the corresponding optics on the printed circuit board. If both optics have the same azimuth angle 884, 884', then the light beam axes 824, 824' run parallel. If the angle is different by 180°, then they intersect at a point in space and both light beam axes 824, 824' are not skewed to each other. If the azimuth angles 884, 884' are not different by 0° or 180°, then the light beam axes 824, 824' are skewed with respect to each other. The azimuth angle 884, 884' describes the tilt direction 827, 827' in the sense of the invention. An embodiment of the present invention includes a lighting unit with at least one group of identical optics and therefore also with the same tilt angle 824, but at the same time with pairwise different tilt directions 827, 827'.

Figure 9:
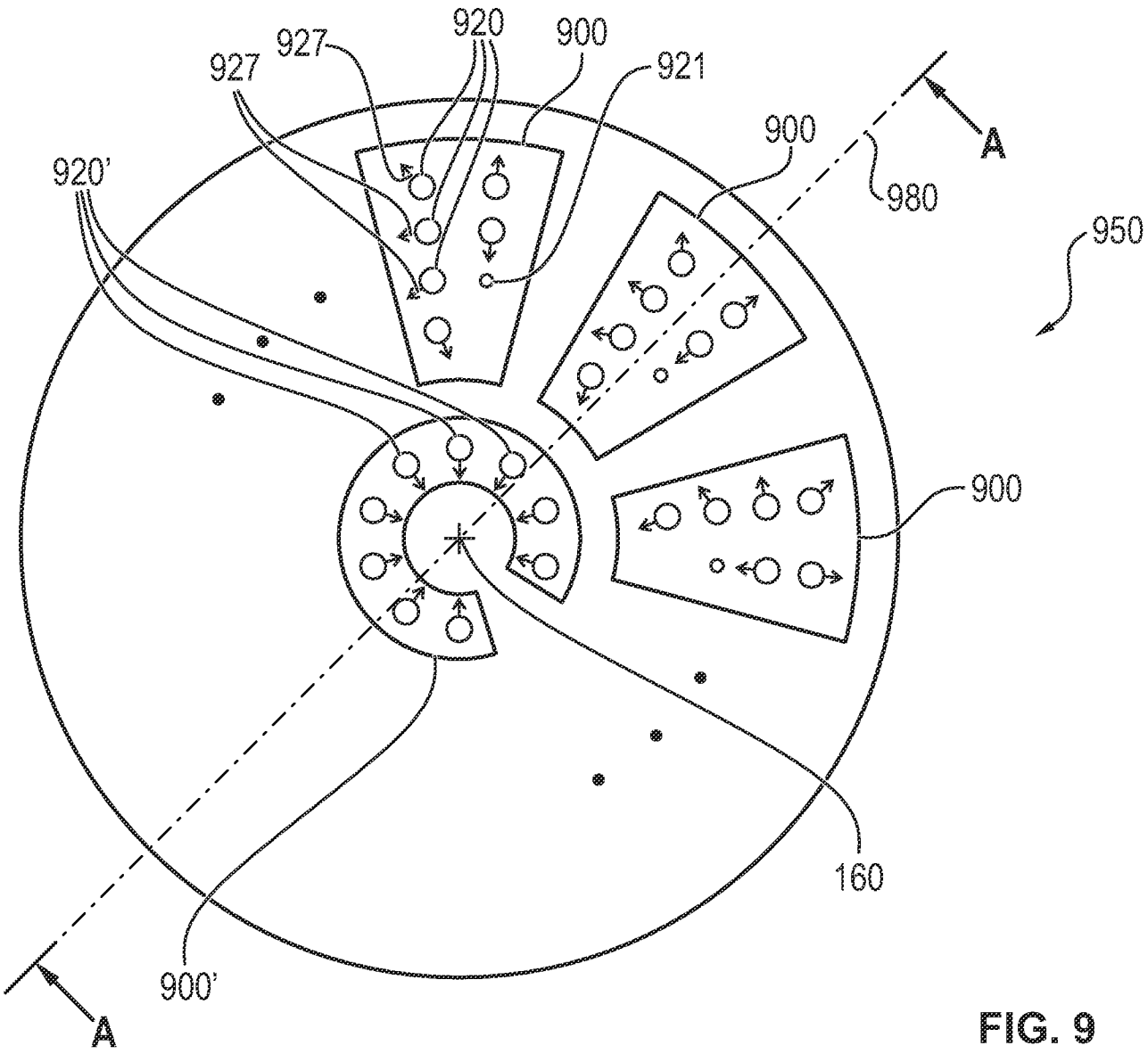
FIG. 9 is a schematic view of a third embodiment of the lighting unit according to the invention for a third embodiment of the luminaire.

FIG. 9 shows a schematic diagram of a third embodiment of the lighting unit according to the invention for 900*a* third embodiment of the luminaire 950.

The lighting unit 900 is present in multiple identical configurations in the luminaire 950. The structure of the LED optics pairs 920, which each have different tilt directions 927 within the respective lighting unit, is not shown in detail for clarity. In addition to the LED optics pairs 920 with tilt direction 927, each lighting unit 700, has an LED optics pair without tilt angle 921 and thus also without tilt direction.

The lighting units 900 are arranged rotationally symmetrically to the luminaire axis 160.

Figure 10:
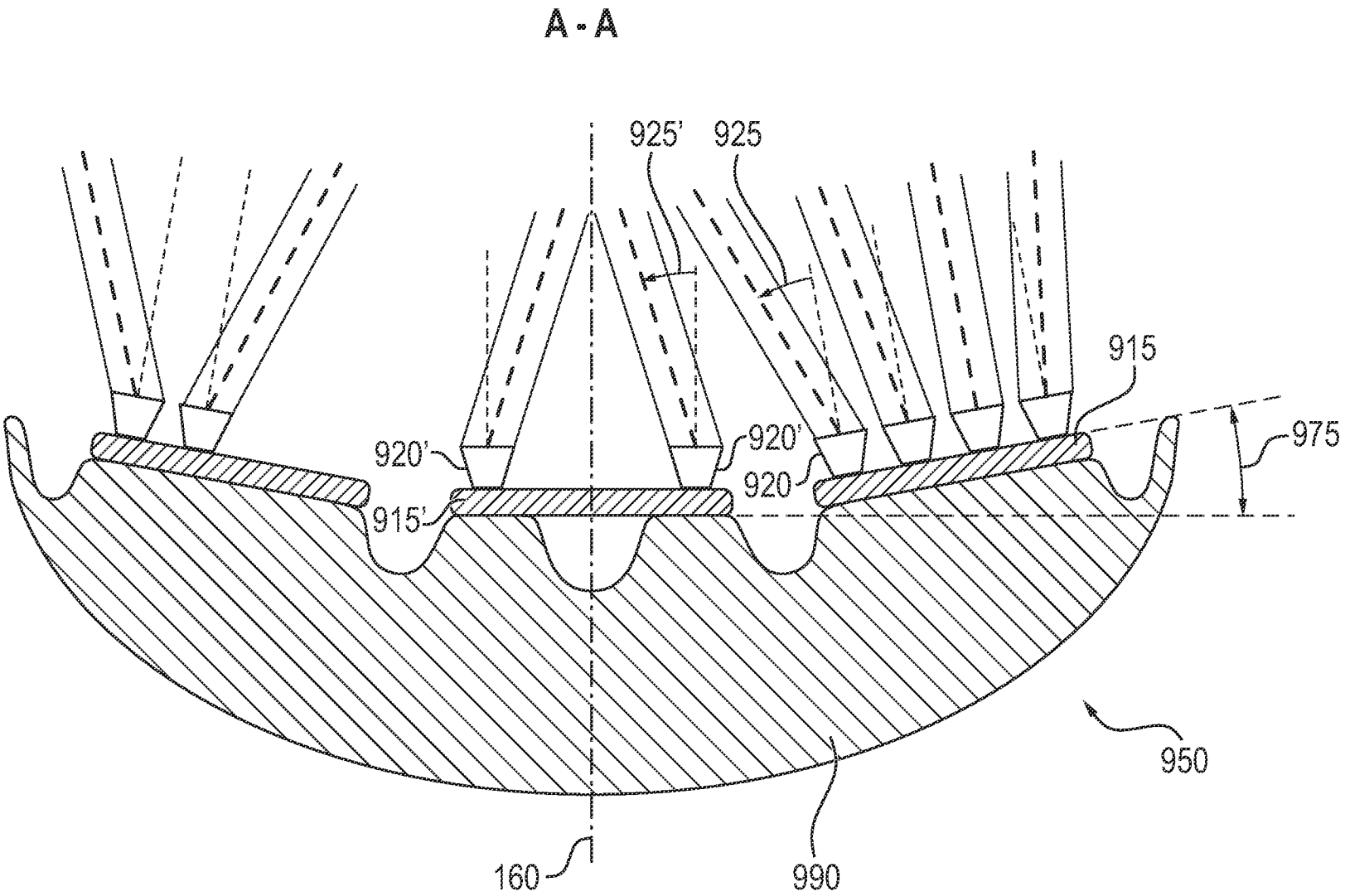
FIG. 10 is a cross-sectional view through the luminaire according to the third embodiment of FIG. 9.

From the cross-sectional view in FIG. 10, it can be seen what influence the change of the tilt direction 927 has on a radiation direction of the provided light beams.

In addition to the rotationally symmetrically arranged lighting units 900, the luminaire 950 has a central lighting unit 900' that is at least partially annularly formed around the luminaire axis 160. The tilt angle 925' of the LED optical pairs 920' of the central lighting unit 900' differs from the tilt angle 925 of the LED optical pairs 920 of the rotationally symmetrically arranged lighting units 900, as shown in FIG. 10. For the two light beams labeled with tilt angle 925, 925', the corresponding tilt angle can be seen from FIG. 10, since the corresponding tilt direction 927 according to FIG. 9 is substantially parallel to the intersection line 980.

Finally, FIG. 10 also shows the arrangement of the LED optical pairs on a respective printed circuit board 915, 915'. Here, the printed circuit board 915 of the rotationally symmetrically arranged lighting unit 900 and the hard disk 915' of the central lighting unit 900' have a plate tilt angle 975 relative to each other. In addition, the advantageous direct connection between the circuit boards 915, 915' and a base body 990 of the luminaire 950 is also shown in FIG. 10. The base body 990 serves as a heat sink of the luminaire 950, so that there is a heat flow from the LEDs to the base body 990. Advantageous materials for the configuration of the components of the luminaire 950 are known to the skilled person, so that they are not be discussed below.

Also shown here are the light beams of the various LED optics pairs and their different tilt angles and tilt directions. Even though it is not clear from FIGS. 9 and 10, some of the light beam axes shown are skewed in pairs so that they do not intersect in the space in front of the luminaire 950.

The structure of each optic may differ between different LED optic pairs.

While specific embodiments of the invention have been shown and described in detail to illustrate the application of the principles of the invention, it will be understood that the invention may be embodied otherwise without departing from such principles.

LIST OF REFERENCE SIGNS

100,600, 600', 900, 900' Lighting unit
110, 110', 110", 610, 610' Group of LEDs
112, 112', 112", 412, 812 LED
812'
115, 415, 615, 615', 815, Printed circuit board
915, 915'
116 Angle of inclination
120, 120', 320, 420, 520, LED optics pair
620, 620', 720, 920, 920'
122, 122', 122", 322, 422, Optics
522, 622, 622'
124, 124', 124", 724, 824 Light beam axis
824', 924
125, 825, 925, 925' Tilt angle
150, 650, 950 Luminaire
155 Mounting for lighting unit
160 Luminaire axis
328, 428, 528 Optics structure
340, 440, 540 Attachment mechanism
342 Contact pin
344 Slot
417 Mounting plate
419 Glass fibers
423 Mirrored wall
442 Annular part
444 Groove
470 Optical output
580 Adjustment unit
627, 727, 827, 827' 927 Tilt direction
611 Subgroup of LEDs
665 Handle
690 Control unit
775 Light field
777 Saddle area
779 Light field distance
884, 884' Polar angle
888 Azimuth angle
921 LED optics pair without tilt angle
975 Plate tilt angle
980 Cutting line
990 Basic body of the lamp

What is claimed is:

1. A lighting unit for a medical light, the lighting unit comprising:

a plurality of groups of LEDs;

a common planar circuit board, the plurality of groups of LEDs being connected to the common planar circuit board; and associated optics, each LED of at least one group of said plurality of groups of LEDs being associated with respective associated optics to form a respective LED optics pair, wherein the respective associated optics of the at least one group of LEDs comprises structure configured to predetermine a tilt angle of a central light beam axis of an emitted light beam of the respective LED optics pair into a tilt direction of the respective LED optics pair, and wherein the tilt direction of the respective associated optics of the at least one group of LEDs is defined such that the respective light beam axes of emitted light beams of the LED optics pairs from the at least one group of LEDs are at least partially skewed relative to each other in skewed pairs of LED optics pairs, wherein the central light beam axis of the skewed pairs, that each have the predetermine tilt angle, do not intersect in space and are not parallel to one another.

2. A lighting unit according to claim 1, wherein the central light beam axes of the LED optics pairs, which are skewed with respect to each other in skewed pairs, each have different tilt directions in pairs to provide pair tilt directions of skewed pairs.

3. A lighting unit according to claim 1, wherein the associated optics of each LED of the at least one group of LEDs comprise identically configured optics.

4. A lighting unit according to claim 1, wherein at least one LED from the at least one group of said plurality of groups of LEDs is associated with at least one further LED to form an LED cluster with the at least one further LED, wherein the LED cluster generates a common light beam with the respective central light beam axis.

5. A lighting unit according to claim 1, wherein the tilt direction of the respective associated optics is fixable to comprise an orientation about an orientation angle within a mounting plane of the respective LED in a direction of which the tilt angle of the pair of LED optics is oriented.

6. A lighting unit according to claim 1, further comprising a fastening mechanism associated with the optics, wherein the tilt direction is fixed via the fastening mechanism, and wherein the fastening mechanism permits secure fixing of the tilt direction via a discretely adjustable mounting of the optics via corresponding contact pins.

7. A lighting unit according to claim 1, further comprising a fastening mechanism associated with the optics, wherein the tilt direction is fixed via the fastening mechanism, and wherein the fastening mechanism comprises a rotatable mounting of the optics relative to the common printed circuit board.

8. A lighting unit according to claim 1, further comprising tilt direction adjustment means configured to adjust the tilt direction or an amount of the tilting angle or both adjust the tilt direction and an amount of the tilting angle of at least of the associated optics.

9. A luminaire comprising:

a lighting unit, the lighting unit comprising:

a plurality of groups of LEDs;

a common planar circuit board, the plurality of groups of LEDs being connected to the common planar circuit board; and associated optics, each LED of at least one group of said plurality of groups of LEDs being associated with respective associated optics to form a respective LED optic pair, wherein the respective associated optics of the at least one group of LEDs comprises structure configured to predetermine a tilt angle of a central light beam axis of an emitted light beam of the respective LED optics pair into a tilt direction of the respective LED optics pair, wherein the tilt direction of the respective associated optics of the at least one group of LEDs is defined such that the respective light beam axes of emitted light beams of the LED optics pairs from the at least one group of LEDs are at least partially skewed relative to each other skewed in pairs of LED optics pairs, wherein the central light beam axis of the skewed pairs, that each have the predetermine tilt angle, do not intersect in space and are not parallel to one another, and wherein the luminaire has a central luminaire axis, and wherein a light field of the luminaire is generated in a plane perpendicular to the luminaire axis at a light field distance from the luminaire by light comprising light from of the lighting unit.

10. A luminaire according to claim 9, wherein a plurality of central light beam axes of the LED optics pairs are formed at an angle to the luminaire axis.

11. A luminaire according to claim 9, further comprising a further lighting unit to provide a plurality of identical lighting units.

12. A luminaire according to claim 9, further comprising a further lighting unit to provide a plurality of lighting units arranged rotationally symmetrically with respect to the luminaire axis.

13. A luminaire according to claim 9, further comprising a further lighting unit to provide a plurality of lighting units, wherein the LED optical pairs of said further lighting unit are arranged on a planar circuit board different from said planar circuit board of said lighting unit.

14. A luminaire according to claim 13, wherein at least two different circuit boards of the lighting units of the luminaire are tilted with respect to each other by a board tilt angle.

15. A luminaire according to claim 9, further comprising at least two different optics that differ at least in the tilt angles defined by the respective optics.

16. A luminaire according to claim 9, wherein LED optical pairs equidistant from the luminaire axis have a respective light beam axis forming angles of substantially equal magnitude with a perpendicular line from a position of the respective LED to the luminaire axis.

17. A luminaire according to claim 9, further comprising a control unit configured to drive at least one subset of LEDs from the at least one group of LEDs separately from other LEDs from the corresponding group of LEDs outside said at least one subset.

18. A lighting unit for a medical light, the lighting unit comprising:

a plurality of groups of LEDs;

a common planar circuit board, the plurality of groups of LEDs being connected to the common planar circuit board; and associated optics, each LED of at least one group of said plurality of groups of LEDs being associated with respective associated optics to form a respective LED optic pair and each LED of at least another group of said plurality of groups of LEDs being associated with different respective associated optics or with no respective associated optics, wherein the respective associated optics of each LED optics pair of the at least one group comprise structure configured to predetermine a tilt angle of a central light beam axis of an emitted light beam in a tilt direction, wherein the associated optics of each LED of the at least one group of LEDs comprise identically configured optics, and wherein the tilt direction of the LED optics pairs from the at least one group of LEDs are at least partially skewed relive to each other in skewed pairs, such that the light beam axes of the skewed pairs do not intersect in space and are not parallel to each other, and wherein the tilt direction of the light beam axes of the skewed pairs each are each different tilt and are rotated about the azimuth angle in relation to a central luminaire axis.

19. A lighting unit according to claim 18, in combination with:

at least another lighting unit to provide a plurality of lighting units; and a base body defining the central luminaire axis, wherein each of the plurality of lighting units are mounted on the base body to provide a luminaire; and wherein a light field of the luminaire is generated in a plane perpendicular to the luminaire axis at a light field distance from the luminaire by light comprising light from of the plurality of lighting units.

* * * * *